US006092599A

United States Patent [19]

Berry et al.

[11] Patent Number: 6,092,599

[45] **Date of Patent: *Jul. 25, 2000**

[54] DOWNHOLE OIL AND WATER SEPARATION SYSTEM AND METHOD

[75] Inventors: Michael R. Berry, Bellaire; Howard L. McKinzie, Sugar Land, both of Tex.; Lon A. Stuebinger, Littleton, Colo.

[73] Assignee: Texaco Inc., White Plains, N.Y.

[ * ] Notice: This patent is subject to a terminal disclaimer.

[21] Appl. No.: 09/154,143

[22] Filed: Sep. 17, 1998

Related U.S. Application Data

[60] Provisional application No. 60/059,732, Sep. 23, 1997, provisional application No. 60/059,733, Sep. 23, 1997, provisional application No. 60/059,781, Sep. 23, 1997, provisional application No. 60/059,734, Sep. 23, 1997, and provisional application No. 60/059,827, Sep. 23, 1997.

[51] Int. Cl.[7] ..... E21B 43/38

[52] U.S. Cl. ..... 166/265; 166/68.5; 166/106; 166/369; 166/54.1

[58] Field of Search ..... 166/265, 266, 166/369, 106, 65.1, 68.5, 54.1, 313; 210/170, 747, 538, 540

[56] References Cited

U.S. PATENT DOCUMENTS

| | | | |
|---|---|---|---|
| 2,214,064 | 9/1940 | Niles . | |
| 2,281,801 | 5/1942 | Reynolds et al. . | |
| 2,910,002 | 10/1959 | Morgan . | |
| 2,986,215 | 5/1961 | Barr . | |
| 3,167,125 | 1/1965 | Bryan . | |
| 3,333,638 | 8/1967 | Bishop . | |
| 3,363,692 | 1/1968 | Bishop . | |
| 3,677,665 | 7/1972 | Corkill . | |
| 3,977,469 | 8/1976 | Broussard et al. . | |
| 4,047,539 | 9/1977 | Kruka . | |
| 4,241,787 | 12/1980 | Price . | |
| 4,251,191 | 2/1981 | Gass et al. . | |
| 4,295,795 | 10/1981 | Gass et al. . | |
| 4,296,810 | 10/1981 | Price . | |
| 4,480,686 | 11/1984 | Coussan . | |
| 4,545,731 | 10/1985 | Canalizo et al. . | |
| 4,745,937 | 5/1988 | Zagustin et al. . | |
| 4,746,423 | 5/1988 | Moyer | 210/104 |
| 4,749,034 | 6/1988 | Vandevier et al. . | |
| 4,753,261 | 6/1988 | Zagustin et al. . | |
| 4,766,957 | 8/1988 | McIntyre . | |
| 4,773,834 | 9/1988 | Saruwatari . | |
| 4,793,408 | 12/1988 | Miffre . | |
| 4,818,197 | 4/1989 | Mueller . | |
| 4,832,127 | 5/1989 | Thomas et al. . | |
| 5,159,977 | 11/1992 | Zabaras . | |
| 5,176,216 | 1/1993 | Slater et al. . | |
| 5,224,837 | 7/1993 | Lamphere et al. . | |
| 5,335,732 | 8/1994 | McIntyre . | |
| 5,425,416 | 6/1995 | Hammeke et al. . | |
| 5,497,832 | 3/1996 | Stuebinger et al. . | |
| 5,562,405 | 10/1996 | Ryall . | |
| 5,579,838 | 12/1996 | Michael . | |
| 5,657,821 | 8/1997 | Beauquin et al. | 166/68 |
| 5,697,448 | 12/1997 | Johnson . | |
| 5,755,554 | 5/1998 | Ryall . | |

FOREIGN PATENT DOCUMENTS

| | | |
|---|---|---|
| 2 194 572 | 3/1988 | United Kingdom . |
| 2 248 462 | 4/1992 | United Kingdom . |
| WO 97/25150 | 7/1997 | WIPO . |

OTHER PUBLICATIONS

T. Kjos et al., SPE Paper No. 030518, Society of Petroleum Engineers, 1995, pp. 689–701.

(List continued on next page.)

*Primary Examiner*—David Bagnell
*Assistant Examiner*—Zakiya Walker
*Attorney, Agent, or Firm*—Harold J. Delhommer; Howrey & Simon

[57] ABSTRACT

The present invention relates to a downhole oil and water separation system having a casing which includes an interval in communication with a producing zone. The system further includes two pumps disposed in the casing for use in lifting segregated produced hydrocarbons and portion of produced water and segregated produced water to the ground surface.

16 Claims, 7 Drawing Sheets

OTHER PUBLICATIONS

B.R. Peachey et al., *Downhole Oil–Water Separation Moves Into High Gear*, 37 Journal of Canadian Petroleum Technology, Jul. 1998, pp. 34–41.

James F. Lea et al., *What's new in artificial lift; Part 2; advances in electrical submersible pumping equipment and instrumentation/control, plus other new artificial lift developments*, World Oil, Apr., 1996, pp. 47–56.

Miller, *The American Oil & Gas Reporter* Jan., 1997, p. 76–80.

Miller, *The American Oil & Gas Reporter*, Mar., 1997, p. 106–109.

Stuebinger et al., SPE Paper No. 38790, *Society of Petroleum Engineers*, 1997, pp. 1–10.

MBC Inc., *Introducing a Concurrent Process of Gas Production/Water Disposal*, 10 pages. (Not dated).

Reda, *Downhole Dewatering Systems*, 6 pages. 1997.

Chriscor, a division of IPEC Ltd., *Chriscor Downhole Water Injection Tool*, 3 pages, (Not dated).

DOWNHOLE OIL AND WATER SEPARATION SYSTEM AND METHOD

The present application claims priority under 35 U.S.C. § 119(e) to provisional applications Ser. Nos. 60/059,732, 60/059,733, 60/059,781, 60/059,734, and 60/059,827, each of which were filed Sep. 23, 1997, the entirety of each of which is incorporated herein by reference.

BACKGROUND OF THE INVENTION

1. Field of the Invention

The present invention relates to an apparatus and method for improving the economics of hydrocarbon production from a producing well. In particular, the present invention relates to an apparatus and method for selectively lifting produced fluid, including produced hydrocarbons and a portion of produced water, to the ground surface and for lifting the remaining produced water to the ground surface.

2. Related Art

Conventional hydrocarbon production wells have been constructed in subterranean strata that yield both hydrocarbons, such as oil and gas, and an undesired amount of water. These wells are usually lined with heavy steel pipe called "casing" which is cemented in place so that fluids cannot escape or flow along the space between the casing and the well bore wall. In some wells, large amounts of water are produced along with the hydrocarbons from the onset of production. Alternatively, in other wells, relatively large amounts of water can be produced later during the life of the well.

The production of excess water to the ground surface results in associated costs in both the energy to lift, or "produce," as well as the subsequent handling of the excess produced water after it has arrived at the surface. Moreover, the produced water must be disposed of after it has been brought to the ground surface. Surface handling of excess water, in addition, creates risks of environmental pollution from such incidents as broken lines, spills, overflow of tanks, and other occurrences. Further, the facilities, lines, and wells required to handle excess water disturb the environment by virtue of their construction and presence. Accordingly, many oil production fields and wells often rapidly become uneconomic to produce hydrocarbons because of excessive water production.

Various apparatuses and methods have been proposed to overcome the problems associated with excess water production and the aforementioned problems associated with lifting, or producing, this water to the ground surface. Several approaches have been used to produce excess water to the ground surface or to avoid producing the excess water to the ground surface by shutting off the water at the entry into the wellbore. Among these means are: installing larger pumps to pump the water to the ground surface; shutting off the water by injecting gels or resins into the formation; and installing mechanical means in the well to interrupt the flow of water into the wellbore. These approaches, however, have not recognized that effective removal of water from oil or gas wells can be accomplished by transferring the accumulated water subsurface to a water-absorbing injection formation.

An evolving approach to the problem of excess water production is to take advantage of the downhole gravity segregation of produced hydrocarbons and produced water in the wellbore. The excess produced water is then conveyed into an injection formation of the subterranean strata while, for example, the oil and a small portion of the produced water that has not fully segregated from the oil are produced, or "lifted," to the ground surface. Such an approach has generally been referred to as an "in-situ" injection method. The conveyance downhole of produced water, without having lifted a majority or all of it to the ground surface, can substantially improve lease revenues or reduce lease operating expenses and investments, thereby extending the economic life of entire fields.

Devices or systems that lift and/or flow hydrocarbons and a portion of the water to the ground surface, while simultaneously injecting the water which has been separated downhole may be referred to by those persons having ordinary skill in the art as "Dual Injection and Lifting Systems (DLALS)," or alternatively, as "Downhole Oil Water Separation (DOWS or DHOWS)."

Generally, such methods have required the availability of a suitable injection formation, either below or above the production zone, with sufficient permeability to permit injection of the excess water into the injection formation. In addition, these in-situ methods have generally employed pumps of the same type (e.g., dual rod pumps). These pump combinations have generally been powered by the same prime mover or drive, such as a conventional pump drive located at the ground surface.

Conventional coupled systems which have been driven by the same prime mover have presented numerous problems with regard to production flexibility in order to accommodate changing reservoir conditions. This is so because it has not been feasible or simple enough to individually control the amount of fluids being lifted to the ground surface and the amount of water being injected by the coupled pumps. For example, the output of the lifting pump in a coupled system, such as a dual-rod pump, may not be variably reduced during production and the output of the injection pump may not be variably increased during production. Such flexibility is needed, for instance, when the well volume remains constant during production but the percentage of oil production decreases with time.

One example of a conventional production apparatus of the coupled in-situ type is a Dual Action Pumping System ("DAPS") that produces oil and a portion of the water from a casing/tubing annulus on the upstroke of the pump, injects water on the downstroke, and uses the gravity segregation of the oil and water within the annulus. Such an apparatus is shown in U.S. Pat. No. 5,497,832, also assigned to the assignee of the present application, the entirety of which is incorporated herein by reference.

Tests of this technology in a number of different wells have shown that gravity segregation of oil and water enable a dual-ported, dual-plunger rod pump to selectively lift produced fluids, including produced hydrocarbons and a portion of produced water, while separating and injecting the remaining produced water into an injection zone within the subterranean strata.

The DAPS apparatus, however, does not solve all of the problems associated with excess water production or changing water production within the subterranean reservoir. Very often, the use of two pumps of the same type (e.g., dual rod pumps) may limit the ability of the pumping system to minimize the amount of water lifted to the ground surface. For example, a system, such as DAPS, using a 1.75" diameter rod pump and a 1.5" diameter rod pump will generally lift approximately 18% of the total produced fluids to the ground surface even though a well may produce less than 5% oil. Further, in coupled systems (i.e., pumps sharing the same prime mover), as noted above, the ability of the systems to adjust to changing water cut production is limited. For example, the various parts of the pump assemblies of coupled systems cannot economically be changed frequently enough to meet changing reservoir conditions.

In a further example of the conventional in-situ approach, coupled rod pumps are used for separating and producing oil from water in a well, while simultaneously injecting the water into the producing formation or into an injection formation below the producing formation. Such an apparatus is shown in U.S. Pat. No. 5,697,448. The apparatus employs three spaced packers (upper, middle, and lower). An oil pump is located between the upper and middle packers, and a water pump is located between the middle and lower packers. Produced oil and water are accumulated between the upper and middle packers. The oil is delivered through an opening into the oil pump and fills a cylinder associated with the oil pump. Produced water is allowed to drain through additional passages into the water pump cylinder where it accumulates for injection. Selective pumping of the oil on the upstroke of the pump and the water on the downstroke of the pump is effected by a set of check valves associated with both the oil and water pumps. Such an apparatus, however, is not an optimal solution to the problems associated with changing water and oil production presented by conventional coupled systems. For example, the apparatus does not provide the flexibility needed to vary the percentage of total reservoir output that is lifted or brought to the ground surface without substantial modifications to the system.

In another example of an in-situ type apparatus, a formation injection tool, mounted to a bottom-hole tubing pump, carries out underground separation and down-bore in-situ transport and injection of the undesired fluids into an injection formation in the production well. Such an apparatus is shown in U.S. Pat. No. 5,425,416. As with the apparatus shown in U.S. Pat. No. 5,697,448, this system does not provide the flexibility needed to quickly and inexpensively change the proportion of fluids lifted to the ground surface as conditions within the subterranean producing strata change.

Moreover, conventional systems such as those described above have failed to provide a simple and effective method for handling high viscosity oils or solids, such as sand, which are present in many production wells. In addition, many wells have become inoperative due to the inability of conventional systems to handle crude oil and gas mixtures or shear sensitive fluids. Conventional wells generally have also not been able to compensate for changes in pressure, such as those that may be caused by gas bubbles.

Thus, there is a need in the art for an apparatus and method that substantially obviates one or more of the limitations and disadvantages of conventional pumping systems. Particularly, there is a need for a system for lifting produced oil and a portion of the produced water to the ground surface, while injecting the remainder of the produced water into an injection formation. There is a particular need for uncoupled systems which have the flexibility to vary the proportions of fluids lifted to the ground surface to the amount of water injected subsurface within the subterranean strata. There is also a need for a simple system for lifting produced water, which has been separated from produced oil downhole, to the ground surface separate from the produced hydrocarbons. Such a system is needed, for example, where a suitable injection zone is not available or when water is needed at the ground surface for other purposes, such as to generate steam or for waterflooding different zones. There is also a need for providing source water for pressure maintenance or waterflooding nearby fields which do not have the potential of utilizing DOWS to lift water from suitable subterranean zones. There is also a need for such systems to be able to handle a variety of conditions within the producing reservoir.

SUMMARY OF THE INVENTION

The present invention solves the problems with, and overcomes the disadvantages of, conventional coupled systems for lifting produced hydrocarbons and a portion of the produced water to the ground surface following gravity segregation, and for separately lifting the remaining produced water to the ground surface.

The present invention relates to a downhole oil and water separation system for selectively lifting produced fluids, including produced hydrocarbons and a portion of produced water, to a ground surface and separately lifting the remaining produced water to the ground surface.

In one aspect, the present invention relates to a downhole oil and water separation system including a casing having an interval. The casing extends from a ground surface downwardly such that the interval communicates with a producing zone so that produced hydrocarbons and produced water from the producing zone collect in the casing and segregate under influence of gravity. The invention further includes a first pump and a second pump disposed in the casing. The first pump is not drivingly coupled to the second pump.

Also included is a first inlet for permitting the segregated produced hydrocarbons to enter the first pump and a second inlet for permitting the segregated produced water to enter the second pump.

In another aspect, the present invention relates to a method for selectively lifting fluids, including produced hydrocarbons and produced water, from a subterranean well to a ground surface.

The method includes allowing produced water and produced hydrocarbons to collect and to segregate above a packer disposed in a casing in the subterranean well. In addition, the method includes controlling a first pump to lift the segregated produced hydrocarbons and a portion of the produced water through a first tubing to the ground surface. The method also includes independently controlling a second pump to lift the segregated produced water through a second tubing to the ground surface.

FEATURES AND ADVANTAGES

Where a suitable injection zone is not available or when water is needed at the ground surface for other purposes, such as to generate steam or for waterflooding different zones, the present invention provides a simple method for utilizing downhole segregation of produced hydrocarbons and produced water such that the hydrocarbons and water may be produced to the ground surface in separate streams. The present invention also provides a simple system for providing source water for pressure maintenance or waterflooding nearby fields which do not have the potential of utilizing DOWS to lift water from suitable subterranean zones. In such an embodiment, the present invention allows for the minimization or elimination of surface equipment, such as "Free Water Knock Outs," fired heaters, separators, or emulsion treating chemicals.

Additional features and advantages of the invention will be set forth in the description that follows, and in part will be apparent from the description, or may be learned in practice of the invention. These descriptions and drawings are intended as illustrative of the invention, and not as limitative thereof.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiments of this invention are shown in some detail, although it will be apparent to those skilled in the relevant art that some features which are not relevant to the invention may not be shown for the sake of clarity.

Figure 1:
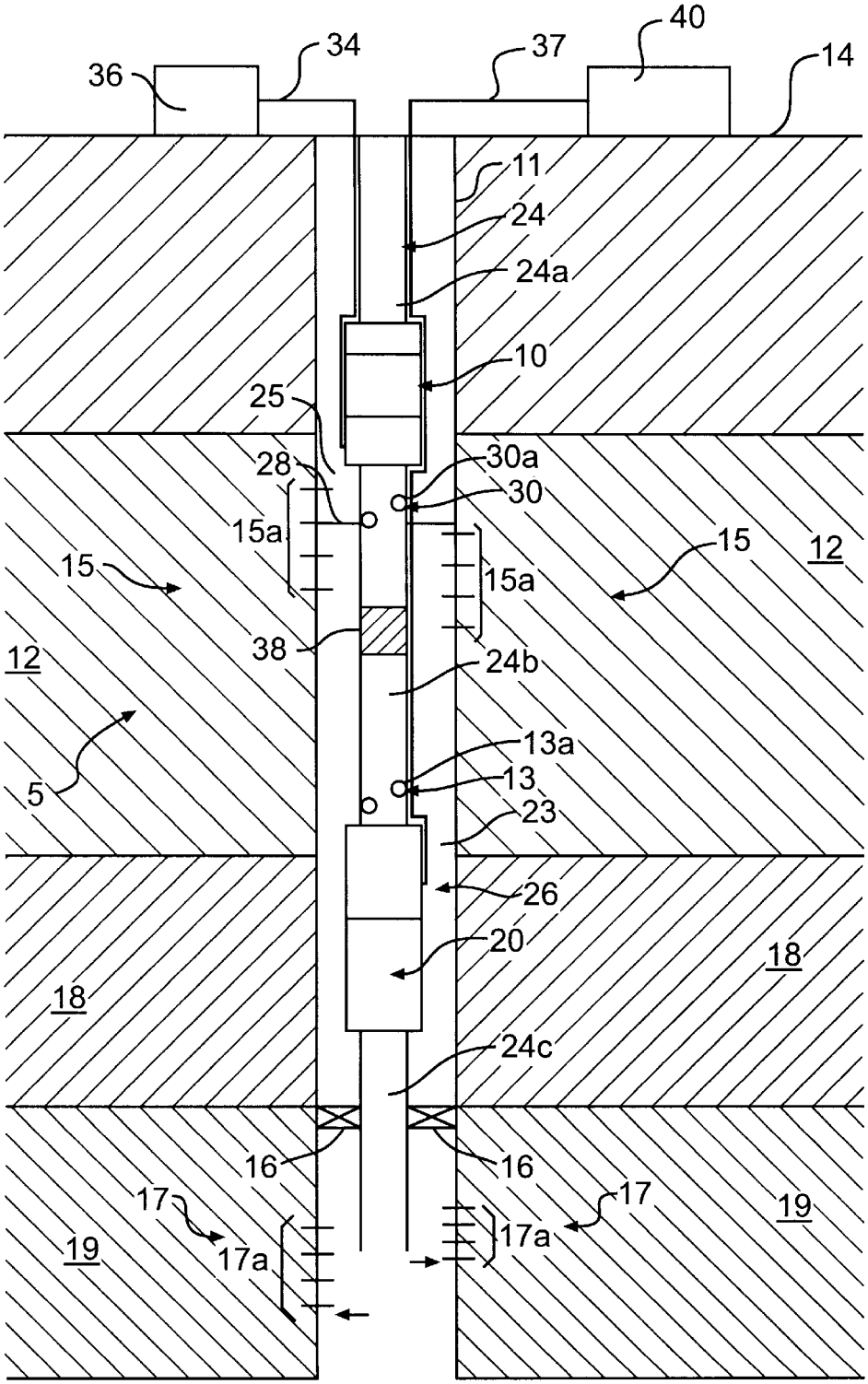
FIG. 1 is a schematic side-elevation sectional view of an exemplary embodiment of the present invention.

Referring first to FIG. 1, there is illustrated, in a schematic side-elevation sectional view, an exemplary embodiment of the present invention and is represented generally by reference numeral 5. A casing 11 is shown extending from a ground surface 14 downwardly within a subterranean well through a hydrocarbon and water producing zone 12 and then to a water injection zone 19. It should be understood by one of ordinary skill in the art that injection zone 19 may alternatively be referred to as a disposal zone. It is preferable to have a long distance or an isolation zone 18 between producing zone 12 and injection zone 19.

As shown in FIG. 1, casing 11 has a producing interval, shown generally at 15, separated from an injection interval, shown generally at 17. Producing interval 15 is located adjacent to and in fluid flow communication with producing zone 12. In a similar manner, injection interval 17 is located adjacent to and in fluid flow communication with disposal, or injection zone 19. Producing interval 15 may preferably be for example, but is not limited to, perforations 15*a* with or without gravel packs in casing 11 as shown in FIG. 1. Alternatively, producing interval 15 may be, but is not limited to, a slotted liner with or without gravel packs, wire-wrapped screens with or without gravel packs, or pre-packed wire-wrapped screens. Likewise, injection interval 17 may preferably be, but is not limited to, perforations 17*a* with or without gravel packs in casing 11 as shown in FIG. 1. As an alternative, injection interval 17 may be a slotted liner with or without gravel packs, wire-wrapped screens with or without gravel packs, or pre-packed wire-wrapped screens. As a further alternative, instead of using injection interval 17, the excess water may be injected directly into an open hole (not shown) within the subterranean strata. Preferably, however, injection interval 17 will be perforations 17*a*.

It should be readily apparent to one skilled in the art that casing 11 may be provided with multiple producing intervals 15 and injection intervals 17 in communication with producing zone 12 and injection zone 19, respectively. Moreover, injection zone 19 can be the same formation as producing zone 12 provided that producing interval 15 and injection interval 17 are not communicating actively (i.e., fluid flow is isolated between producing interval 15 and injection interval 17). It should be understood by those of skill in the art, however, that fluids produced into casing 11 through producing interval 15 and water injected through injection interval 17 may influence the flow parameters of each other.

Casing 11 surrounds a tubing 24 which extends from ground surface 14 downwardly within casing 11. Tubing 24 preferably includes three tubing sections, 24*a*, 24*b*, and 24*c*. It should be apparent to one of ordinary skill in the art that tubing 24 may include any number of tubing sections depending, of course, upon the particular configuration of the well.

A first pump 10 is disposed at an end of first tubing section 24*a* which extends from ground surface 14 downwardly within casing 11. Tubing section 24*b* extends between and is coupled to first pump 10 and a second pump 20. Second pump 20 is preferably disposed below first pump 10 in casing 11 on tubing 24, or more particularly, on second tubing section 24*b*. Tubing section 24*c* is coupled to second pump 20 and extends downwardly within casing 11 below a packer 16 disposed in casing 11.

First pump 10 and second pump 20 are shown in the embodiment of FIG. 1 uncoupled relative to each other. Particularly, first pump 10 is not drivingly coupled to second pump 20. First pump 10 and second pump 20 are preferably controlled by individual drives as will be described in more detail below. This configuration allows the individual pump rates to be separately controlled to respond to changing reservoir conditions. Moreover, individual rates of lift and injection can be separately controlled to optimize overall field performance.

In the embodiment shown in FIG. 1, first pump 10 is an electrical submersible progressive cavity pump (ESPCP) and second pump 20 is an electrical submersible pump (ESP). An electrical submersible centrifugal pump is particularly preferred. In an alternate embodiment of the present invention, first pump 10 is an ESP and second pump 20 is an ESPCP.

As noted above, packer 16 is disposed within casing 11, preferably between producing interval 15 and injection interval 17. Casing 11 and packer 16 are configured to permit produced hydrocarbons and produced water to collect above packer 16. By "produced hydrocarbons" is meant crude oil, gas, gas condensate, and various combinations thereof. Particularly, tubing 24, casing 11, and packer 16, together define casing/tubing annulus 26 that extends upward to ground surface 14. Hydrocarbons, such as oil or gas, and water flow or are "produced," into casing 11 through producing interval 15. The hydrocarbons and water segregate by gravity within casing/tubing annulus 26 forming a hydrocarbon/water interface 28. Gravity segregation, as used herein, is intended to describe the preservation of the isolation between produced hydrocarbons and water, as opposed to separation which indicates that a mixture is mechanically divided into separate fluids. Thus, the produced hydrocarbons and water are allowed to collect in annulus 26 above packer 16 and to segregate by gravity to form segregated produced water 23 below hydrocarbon/water interface 28 and segregated produced hydrocarbons and a small proportion or portion of produced water 25 above hydrocarbon/water interface 28.

A first, or upper inlet 30 is preferably disposed in tubing 24, or more particularly, in an upper end of tubing section 24*b*, below first pump 10. First inlet 30 is disposed in a region of casing 11, or more particularly, in a region of casing/tubing annulus 26, where segregated hydrocarbons and only a small proportion or portion of water are expected to be present and preferably, adjacent hydrocarbon/water interface 28. As shown in the exemplary embodiment in FIG. 1, first inlet 30 may be sets of perforations 30*a* in tubing 24. Alternatively, first inlet 30 may be a port or multiple ports or other suitable mechanisms for conducting fluid flow. Preferably, however, first inlet 30 will be sets of perforations 30*a*. First inlet 30 is configured to permit produced hydrocarbons and any portion of water that has not segregated from the hydrocarbons 25 to enter first pump 10. The operation of first inlet 30 will be described in more detail below.

A second, or lower inlet 13 is shown disposed in tubing 24, or more particularly, in a lower end of tubing section 24*b*, above second pump 20. Second inlet 13 is preferably disposed in a region of casing 11, or more particularly, in a region of casing/tubing annulus 26, where primarily only the heavier segregated produced water is present (i.e., inlet 13 is in fluid-flow communication primarily with segregated produced water 23). As shown in FIG. 1, second inlet 13 may be sets of perforations 13*a* in tubing 24 or second tubing section 24*b*. Second inlet 13 is configured to permit the segregated produced water from producing zone 12 to enter second pump 20 and to be injected into disposal zone 19 as will be discussed in more detail below. It may also be desirable, although not required, to dispose a tubing plug 38 in tubing 24, or more particularly second tubing section 24*b*, between first pump 10 and second pump 20, in order to maintain separation of the segregated produced hydrocarbons and a portion of the produced water 25 and the segregated produced water 23 within second tubing section 24*b*.

A first variable speed drive 36 may be disposed at ground surface 14 to provide power to and control the pump rate of first pump 10. First pump 10 is preferably coupled to first variable speed drive 36 by a first electrical line or cable 34. Similarly, a second variable speed drive 40 may be disposed at ground surface 14 to provide power to and control the pump rate of second pump 20. Second pump 20 is preferably coupled to second variable speed drive 40 by a second electrical line or cable 37.

Reference will now be made to the operation of the first exemplary embodiment shown in FIG. 1. In operation, produced fluids (hydrocarbons and water) are produced from producing zone 12 via intervals 15 into casing 11 above packer 16 forming a column of produced hydrocarbons and water within casing/tubing annulus 26. The lighter produced fluids (mostly hydrocarbons 25) rise to the top of the column while the heavier fluids (mostly water 23) settle to the bottom of the column.

Segregated hydrocarbons and a small portion of water 25 then flow, or are "pulled," through first inlet 30 and into tubing 24 below first pump 10. First pump 10 then pumps the segregated hydrocarbons and a small portion of water 25 (as will be described in more detail with reference to FIG. 4) through tubing 24 to ground surface 14 where it is collected in a well-known manner. It is preferred that, during production, hydrocarbon/water interface 28 is maintained adjacent first inlet 30 in order to provide stabilized pumping conditions. In order to meet the capacity of first pump 10 and to ensure that hydrocarbon/water interface 28 is maintained adjacent first inlet 30, an upper portion of segregated produced water 23 (in addition to produced hydrocarbons and portion of produced water 25) may be "pulled" by first pump 10 through first inlet 30 and pumped to ground surface 14.

Simultaneously, segregated produced water 23 that has settled at the bottom of the casing/tubing annulus 26 flows through second inlet 13 and into second pump 20. The segregated water is then pumped, or injected, through the end of tubing section 24*c* and into casing 11 below packer 16 and thereafter into injection zone 19.

It should be understood by one skilled in the art that first pump 10 and second pump 20 may include sensors (not shown) for flow rate, pressure, and temperature measurement or other types of control information which is transmitted to variable speed drives, 36 and 40. Thus, first pump 10 and second pump 20 are individually and independently controllable to provide maximum flexibility in selecting pump output to optimize reservoir performance and to allow conformance to changing reservoir conditions. Moreover, because first pump 10 and second pump 20 are separately controlled (i.e., first pump 10 is controlled by first variable speed drive 36 and second pump 20 is controlled by second variable speed drive 40), their respective pump output may be separately and independently varied to correspond to the changing reservoir conditions during production.

The entire combination of first pump 10 and second pump 20 may typically be about 30 feet to several hundred feet in length. Moreover, the distance from producing intervals 15 to packer 16, percentage of water cut and injection rate, and designed production rate can all be variables in deciding whether it is desirable to place second pump 20 just above packer 16 or higher in the well.

Figure 2:
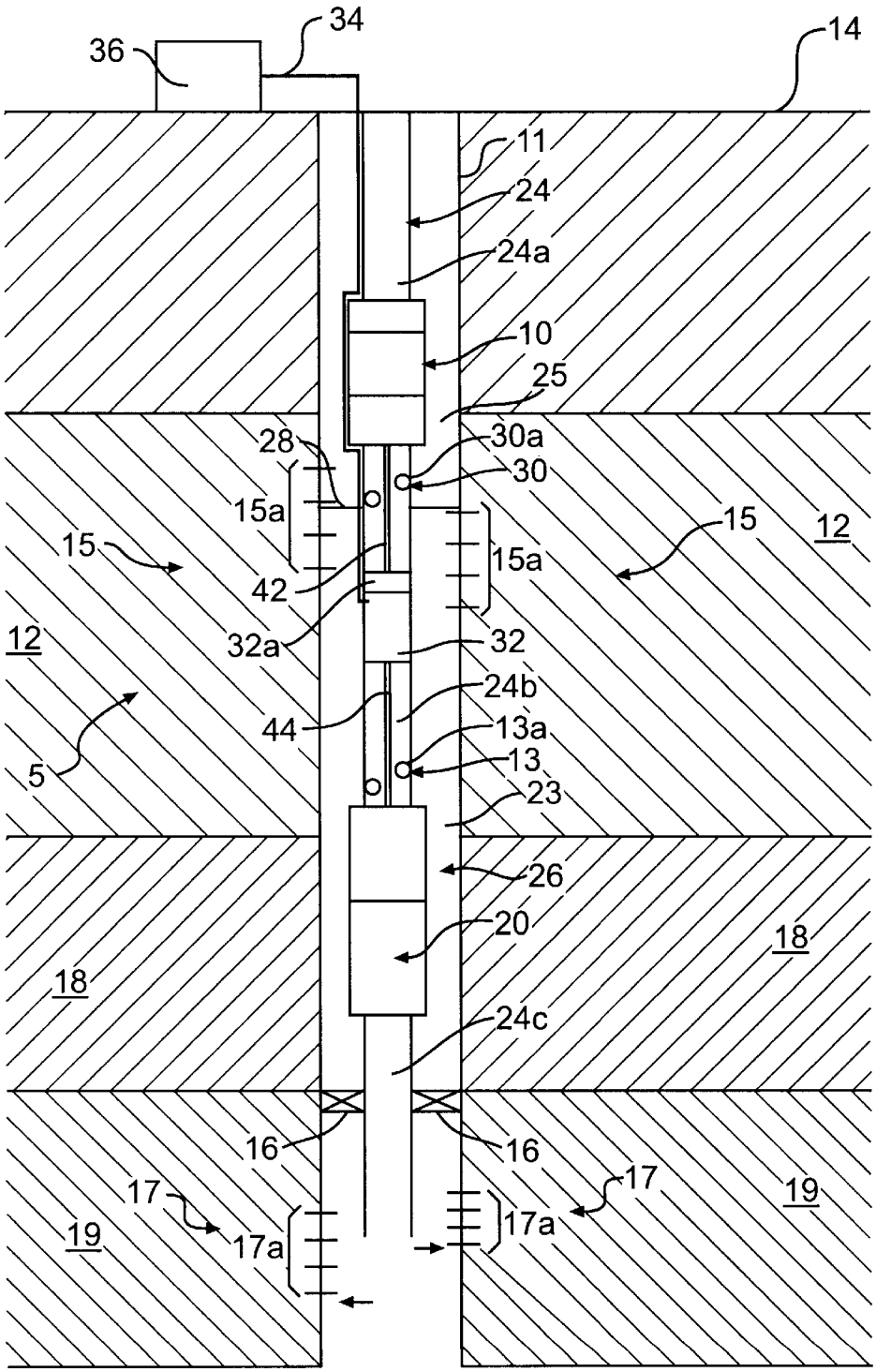
FIG. 2 is a schematic side-elevation sectional view of a second exemplary embodiment of the present invention.

Reference will now be made to FIG. 2, wherein a second embodiment of the present invention is shown employing a single submersible electric motor 32 to separately provide power to and control first pump 10 and second pump 20. Like reference numerals will be used where appropriate to describe similar elements to those of the embodiment shown in FIG. 1.

In FIG. 2, motor 32 is shown disposed in casing 11, and more particularly, in tubing section 24*b* between first pump 10 and second pump 20. Preferably, motor 32 will be axially aligned with first pump 10 and second pump 20. Motor 32 includes an upper drive shaft 42 coupled to first pump 10 through a gearbox 32*a*. Additionally, a lower drive shaft 44 is coupled between motor 32 and second pump 20.

Variable speed drive 36 is disposed at ground surface 14 to provide power to motor 32 and to control the output of motor 32 (e.g., speed of rotation). Motor 32 is preferably coupled to variable speed drive 36 by electrical line or cable 34. The remaining elements shown in FIG. 2 have been described above with reference to FIG. 1, and for the sake of brevity are herein incorporated by reference.

Reference will now be made to the operation of the second exemplary embodiment shown in FIG. 2. In operation, produced fluids (hydrocarbons and water) are produced from producing zone 12 via intervals 15 into casing 11 above packer 16 forming a column of produced hydrocarbons and water within casing/tubing annulus 26. The lighter produced fluids (mostly hydrocarbons) rise to the top of the column while the heavier fluids (mostly water) settle to the bottom of the column.

Segregated hydrocarbons and a small portion of water 25 then flow through first inlet 30 and into tubing 24 below first pump 10. First pump 10, driven by motor 32 via gearbox 32*a*, pumps the segregated hydrocarbons and small portion of water 25 through tubing 24 to the ground surface 14 where it is collected in a well-known manner.

Simultaneously, segregated produced water 23 which has settled at the bottom of casing/tubing annulus 26 flows through second inlet 13 and into second pump 20. The segregated water is then pumped, or injected through the end of tubing section 24*c* and into casing 11 below packer 16 and thereafter into injection zone 19.

Figure 3:
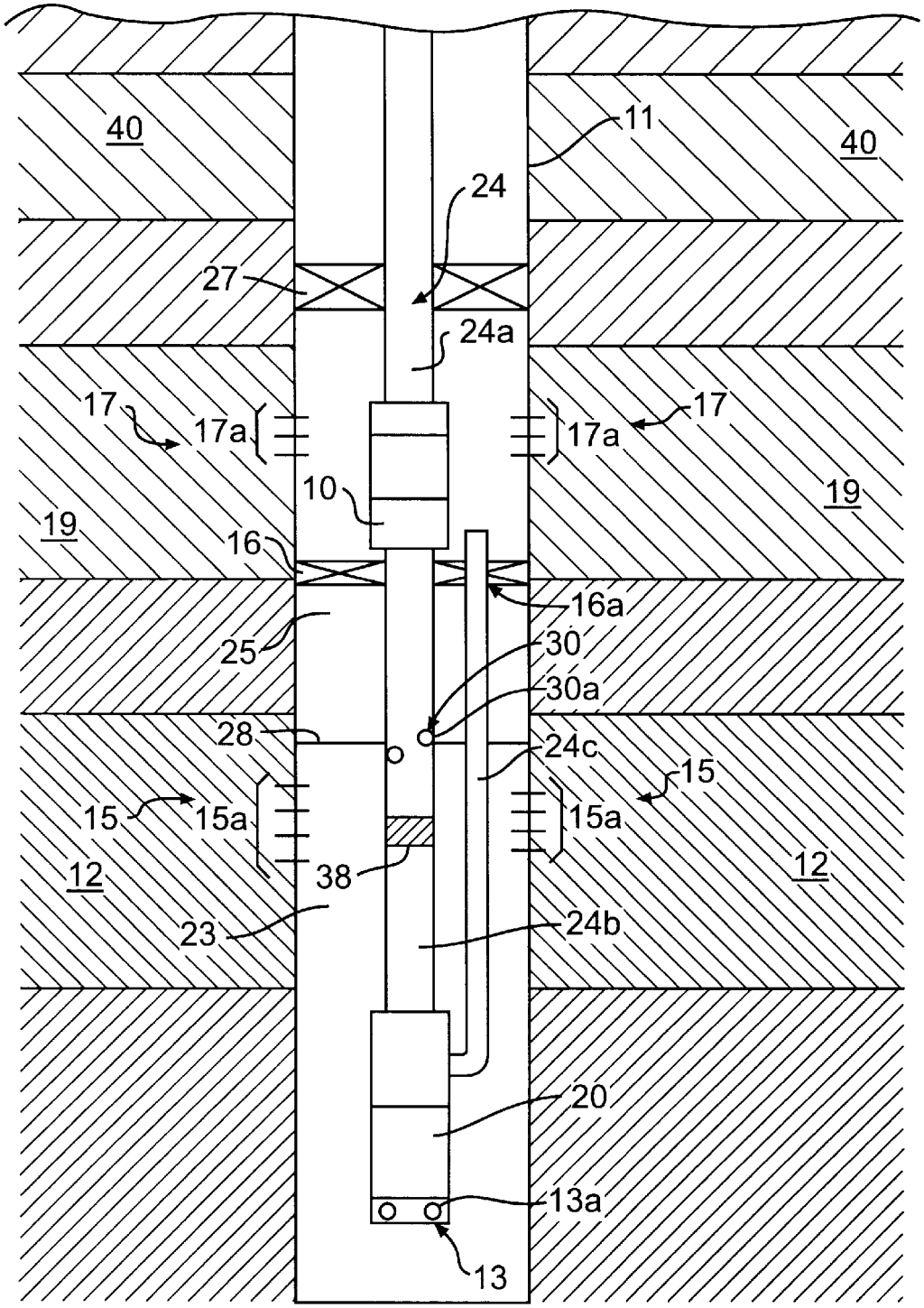
FIG. 3 is a schematic side-elevation sectional view of a third exemplary embodiment of the present invention shown with an injection zone overlying a producing zone in the subterranean reservoir.

Reference will now be made to FIG. 3, wherein a second embodiment of the present invention is shown in which third tubing section 24*c* is coupled to second pump 20 for injecting produced water into disposal zone 19 which is located above producing zone 12. In this embodiment, second pump 20 is preferably disposed at the end of tubing 24, or more particularly, at the end of second tubing section 24*b*.

As can be seen in FIG. 3, third tubing section 24*c* extends up casing/tubing annulus 26 and through a passage 16*a* in packer 16. A second packer 27 is disposed in casing 11 preferably above injection zone 19. Packer 16 and second packer 27 are configured to isolate injection zone 19 within casing 11 from both producing zone 12 and, for example, an isolated aquifer 40. Second inlet 13 is shown disposed on a lower end of second pump 20 such that segregated produced water 23 passing through second pump 20 may be used for cooling purposes.

Tubing plug 38 may be disposed in tubing 24, or more particularly in second tubing section 24*b*, between first pump 10 and second pump 20 in order to isolate segregated hydrocarbons and portion of produced water 25 from segregated produced water 23 within tubing 24.

During operation of the system shown in FIG. 3, first pump 10 lifts segregated produced hydrocarbons and a portion of produced water 25 to ground surface 14 in the manner described above. At the same time, second pump 20 pumps segregated produced water 23 that enters second pump 20 through second inlet 13 through third tubing section 24*c* and thereafter into disposal zone 19 via injection interval 17.

Figure 4:
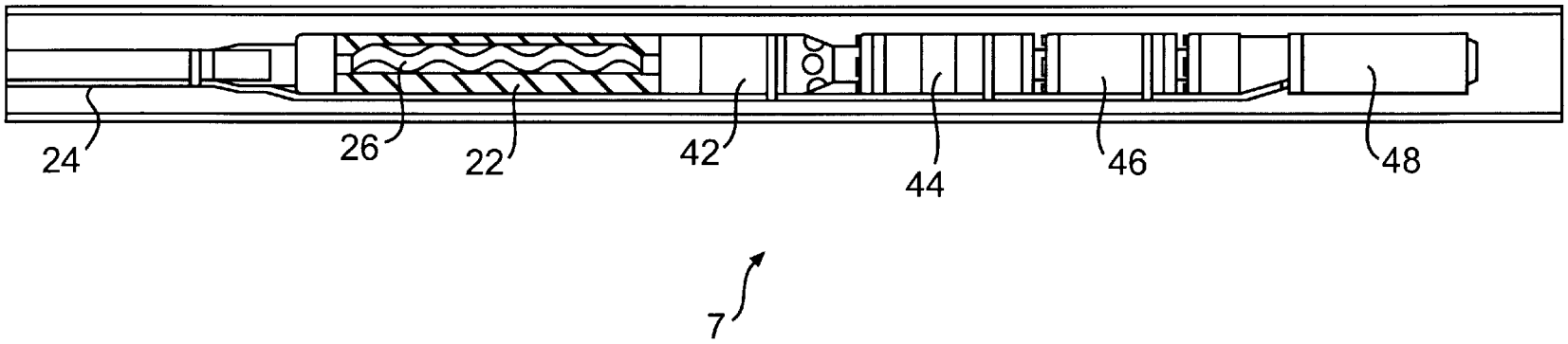
FIG. 4 is a schematic side-elevation view illustrating an exemplary electrical submersible progressive cavity pump suitable for use in the present invention.

Reference will now be made to FIG. 4, which is provided to illustrate a schematic partial view of an exemplary electrical submersible progressive cavity pump (ESPCP) suitable for use with the present invention, represented generally as reference numeral 7. An exemplary electrical submersible progressive cavity pump suitable for use with the present invention is shown in U.S. Pat. No. 3,677,665, the entirety of which is incorporated herein by reference. When used with the present invention, ESPCP 7 is preferably coupled to tubing 24 as described above, however, ESPCP 7 may also be disposed within tubing 24.

The ESPCP preferably comprises a helically shaped rotor 26 and a stator 22. Rotor 26, which is the ESPCP's only moving part, is usually in the shape of a single external helix with a round cross section. Rotor 26 is normally plated with a hardened surface coating for abrasion resistance in the presence of sand, formation residue chips, or the like. Stator 22 is generally formed of a very firm, but elastomeric compound (such as synthetic rubber) and usually has a double internal helix. Its external shape is generally cylindrical and therefore provides a surface which may be bonded to a pump body. Rotor 26 is suspended in stator 22 and may be powered (i.e., rotated) by an electrical submersible motor 48 via a gear reduction drive 46 which is used preferably as a conventional speed reducer. A flex shaft 42 and a seal section 44 are coupled together and located between rotor 26 and gear reduction drive 46.

In operation, as internal helical pump rotor 26 is turned by motor 48, a series of cavities are formed between the helices of rotor 26 and stator 22 beginning at the intake end and progressing, with the rotary motion, to the output end. The progressive cavities cause fluid to be pumped from the input end to the output end. If rotor 26 is chosen to have a right hand pitch helix, then a vertical pump placed in a well will input fluid into its lower end 29 and output fluid from its upper end 31 with right hand rotation. Conversely, if rotor 26 is chosen to have a left hand pitch helix, then a vertical pump placed in a well will input fluid from its upper end 31 and output the fluid from its lower end 29.

The ESPCP is highly efficient when compared to other oil field pumps in common usage. For example, a typical electrical-powered submersible centrifugal pump is from about 25% to 45% efficient. A hydraulic jet pump usually runs from about 15% to 30% efficient. Sucker rod powered mechanical pumps generally run from about 45% to 50% efficient. Conversely, ESPCP's usually run from about 70% to 95% efficient. The ESPCP can also handle solids or very heavy crude oil where more delicate electric pump impellers, electric motors or gearboxes on sucker rod pumping units fail. While a hydraulic jet pump can efficiently operate in high solids environment, its operating efficiency is only about one third of the ESPCP. ESPCP's that are commercially available can operate at production rates of up to 5,200 barrels of fluid per day from shallow wells. ESPCP's are capable of operating at depths up to about 5,000 feet, with fluid density from 6 to 45 American Petroleum Institute (API) degrees gravity, at temperatures up to 300° F./150° C. and in salty, sandy and high viscosity fluids. However, at such depths the volume of fluid produced would be less than producing from shallow wells.

Figure 5:
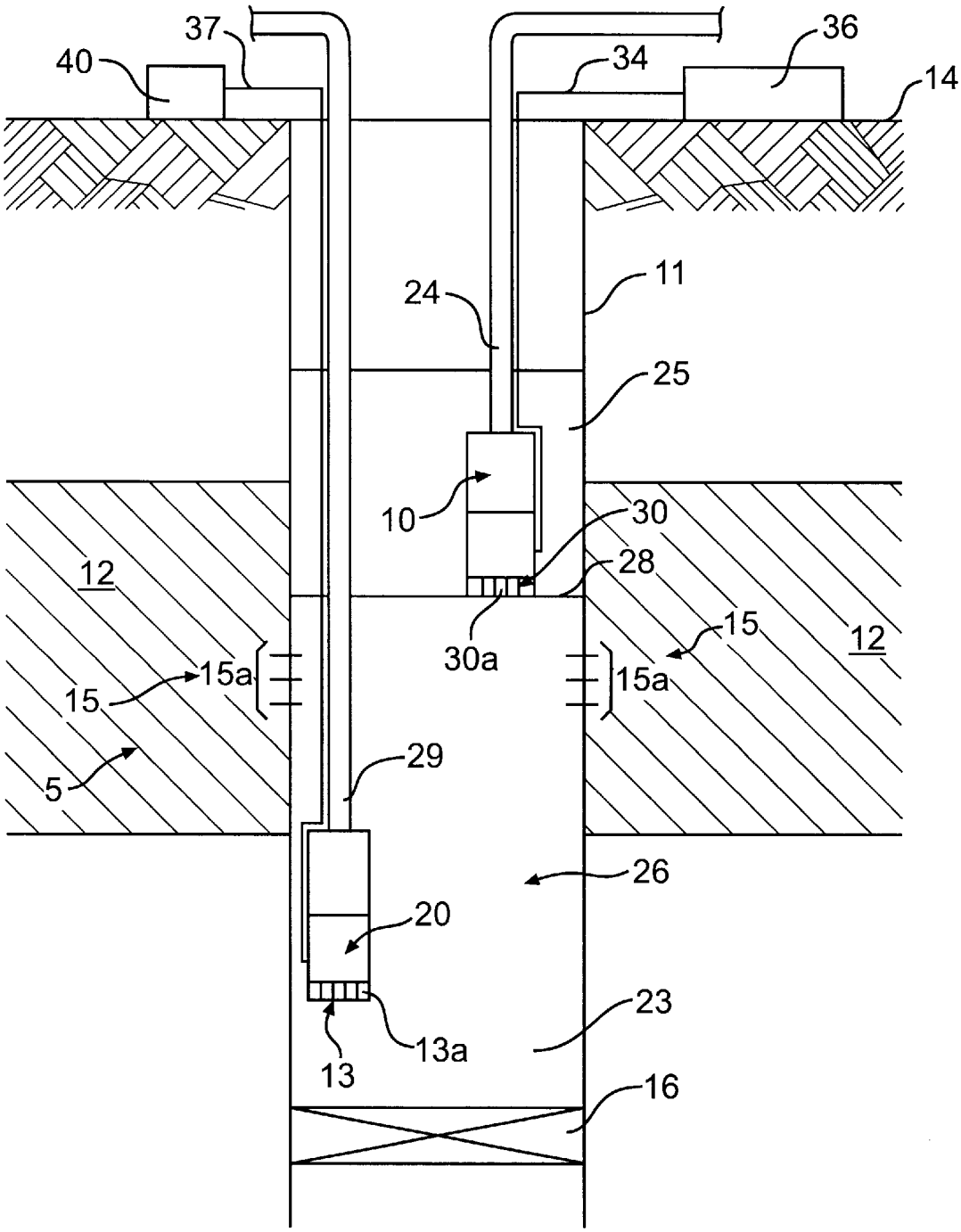
FIG. 5 is a schematic side-elevation view of a fourth exemplary embodiment of the present invention.

Reference will now be made to FIG. 5, wherein a fourth embodiment of the present invention is shown employing a first pump 10 coupled to a first tubing 24 and a second pump 20 coupled to a second tubing 29. Tubing 24 and tubing 29 are preferably coupled to suitable fluid collection mechanisms (not shown), such as tanks or pipelines, at ground surface 14. First pump 10 may be an electrical submersible pump, an electrical submersible progressive cavity pump, or any other suitable downhole pump. Similarly, second pump 20 may be an electrical submersible pump, an electrical submersible progressive cavity pump, or any other suitable downhole pump. First pump 10 is not drivingly coupled to second pump 20.

A first variable speed drive 36 may preferably be disposed at ground surface 14 to provide power to and control the pump rate of first pump 10. First pump 10 is preferably coupled to first variable speed drive 36 by a first electrical line or cable 34. Similarly, a second variable speed drive 40 may preferably be disposed at ground surface 14 to provide power to and control the pump rate of second pump 20. Second pump 20 is preferably coupled to second variable speed drive 40 by a second electrical line or cable 37.

A casing 11 is shown extending from ground surface 14 downwardly within the subterranean well through a hydrocarbon and water producing zone 12. Casing 11 has a producing interval, shown generally at 15, located adjacent to and in fluid flow communication with producing zone 12. As described above, producing interval 15 may be sets of perforations 15*a*. A mechanical sealing device, or "seal" 16 is shown disposed within casing 11, preferably below second pump 20. Seal 16 may preferably be a bridge plug, a packer, or other suitable mechanical sealing device used when encroachment of water from downhole in casing 11 is a problem. It should be understood by one of ordinary skill in the art that seal 16 may not be required if water encroachment is not a problem and conditions within the well permit produced hydrocarbons and produced water to sufficiently collect in casing 11 and to segregate under the influence of gravity. Casing 11, seal 16, tubing 24, and tubing 29, together define casing/tubing annulus 26 that extends upward to ground surface 14. Hydrocarbons, such as oil or gas, and water flow or are "produced," into casing 11 through producing interval 15. The hydrocarbons and water segregate by gravity within casing/tubing annulus 26 forming a hydrocarbon/water interface 28. Thus, the produced hydrocarbons and water are allowed to collect in annulus 26 above seal 16 and to segregate by gravity to form segregated produced water 23 below hydrocarbon/water interface 28 and segregated produced hydrocarbons and a small proportion or portion of produced water 25 above hydrocarbon/water interface 28.

A first, or upper inlet 30 is preferably disposed at a lower end of first pump 10. First inlet 30 is preferably disposed in a region of casing 11, or more particularly, in a region of casing/tubing annulus 26, where segregated hydrocarbons and only a small proportion or portion of water 25 are expected to be present and preferably, adjacent hydrocarbon/water interface 28. First inlet 30 is preferably sets of perforations 30*a*. The operation of first inlet 30 will be described in more detail below.

A second, or lower inlet 13 is shown disposed at a lower end of second pump 20. Second inlet 13 is preferably disposed in a region of casing 11, or more particularly, in a region of casing/tubing annulus 26, where primarily only the heavier segregated produced water 23 is present (i.e., inlet 13 is in fluid-flow communication primarily with segregated produced water 23). Second inlet 13 is preferably sets of perforations 13*a*.

Reference will now be made to the operation of the exemplary embodiment shown in FIG. 5. In operation, produced fluids (hydrocarbons and water) are produced from producing zone 12 via intervals 15 into casing 11 above seal 16 forming a column of produced hydrocarbons and water within casing/tubing annulus 26. The lighter produced fluids (mostly hydrocarbons 25) rise to the top of the column while the heavier fluids (mostly water 23) settle to the bottom of the column.

Segregated hydrocarbons and a small portion of water 25 then flow through first inlet 30 and into first pump 10. First pump 10 then pumps the segregated hydrocarbons and small portion of water 25 through tubing 24 to ground surface 14 where it is collected in a well-known manner. It is preferred that, during production, hydrocarbon/water interface 28 is maintained adjacent first inlet 30 in order to provide stabilized pumping conditions. In order to meet the capacity of first pump 10 and to ensure that hydrocarbon/water interface 28 is maintained adjacent first inlet 30, an upper portion of segregated produced water 23 (in addition to produced hydrocarbons and portion of produced water 25) may be "pulled" by first pump 10 through first inlet 30 and pumped to ground surface 14.

Simultaneously, segregated produced water 23 which has settled at the bottom of casing/tubing annulus 26 flows or is "pulled" into second inlet 13 and into second pump 20. The segregated water is then pumped through tubing 29 to ground surface 14 where it is also collected in a well-known manner.

Figure 6:
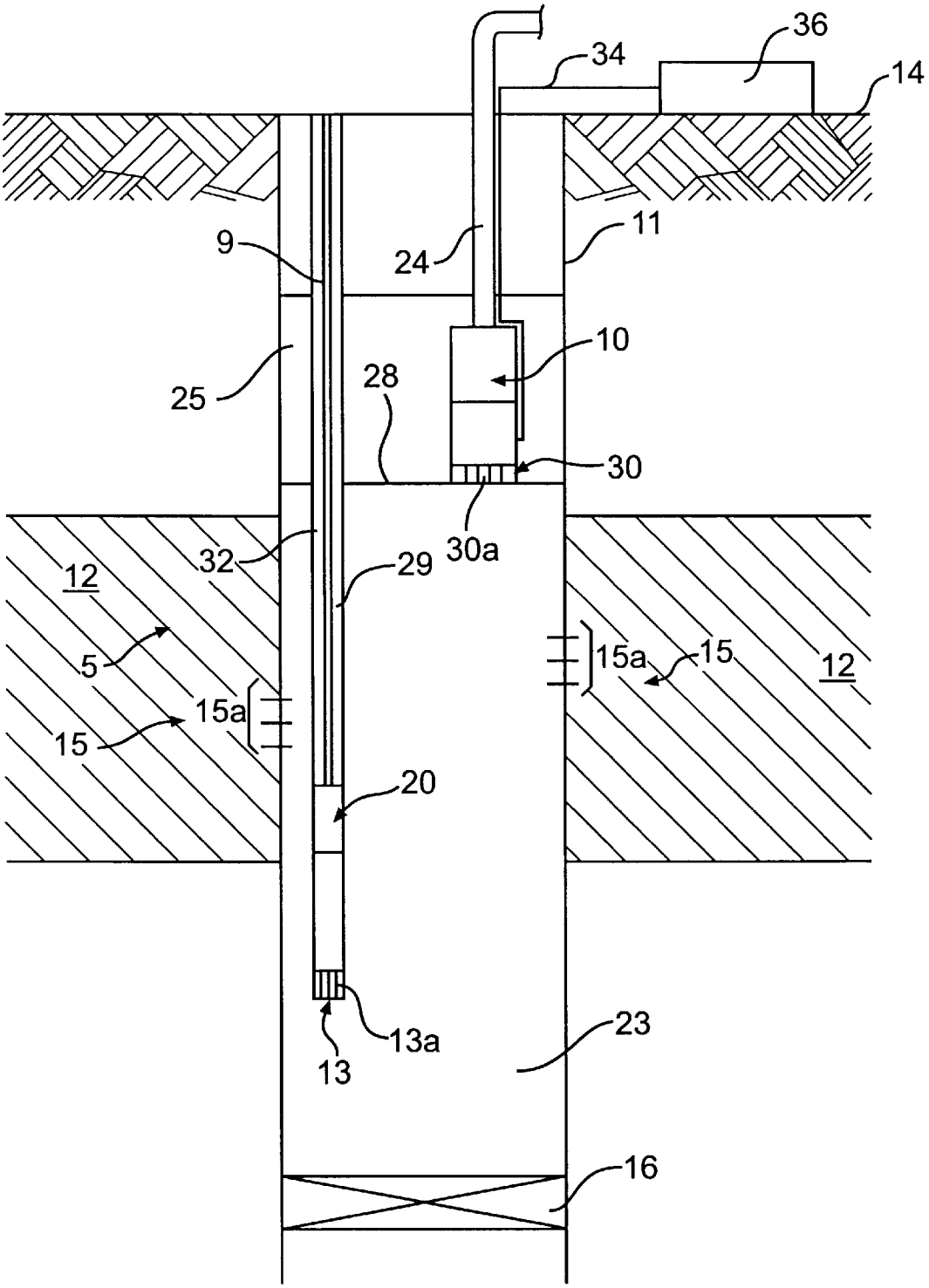
FIG. 6 is a schematic side-elevation view of a alternate embodiment of the fourth exemplary embodiment shown in FIG. 5.

Reference will now be made to FIG. 6, wherein an alternate embodiment of the embodiment of FIG. 5 is shown. In this embodiment, second pump 20 is shown preferably disposed in second tubing 29 whereas first pump 10 is shown coupled to first tubing 24 as described above. Second pump 20 may be a surface-driven rod pump or alternately, a surface rod-driven progressive cavity pump. Alternatively, first pump 10 could be disposed in first tubing 24 and second pump 20 could be coupled to second tubing 29 as described above. Similarly, in this arrangement, first pump 10 could be a surface-driven rod pump or a surface rod-driven progressive cavity pump. As a further alternative, first pump 10 and second pump 20 could be disposed in tubing 24 and tubing 29, respectively.

It should be apparent to one of ordinary skill in the art that any type of rod pump (including, for example, but not limited to, insert, tubing, and various American Petroleum Institute (API) pump types) may be used to provide flexibility for varying conditions within the producing well. As shown in FIG. 6, second pump, or rod pump 20 is preferably sealingly disposed in second tubing 29. Second, or lower inlet 13 is preferably disposed in tubing 29 below second pump 20 and is disposed in a region of casing 11 where segregated produced water is expected to be present.

A sucker rod string 9 is also disposed in second tubing 29. Rod string 9 extends to ground surface 14 where it is reciprocated through an upstroke and a downstroke by a conventional pump drive (not shown). As rod string 9 is reciprocated through an upstroke and a downstroke, second pump 20 reciprocates through an upstroke and a downstroke.

Reference will now be made to the operation of the alternate exemplary embodiment shown in FIG. 6 employing a surface-driven rod pump as second pump 20. In operation, produced fluids (hydrocarbons and water) are produced from production zone 12 via intervals 15 into casing 11 above optional seal 16 thereby forming a column of produced hydrocarbons and water within casing/tubing annulus 26. The lighter produced fluids (mostly hydrocarbons 25) rise to the top of the column while the heavier fluids (mostly water 23) settle to the bottom of the column.

During the upstroke of second, or rod pump 20, segregated produced water flows through second inlet 13 and into second tubing 29 below second pump 20. A traveling valve (not shown) disposed in second pump 20 is open during the upstroke which permits the segregated produced water to flow through second pump 20 to form a column of produced water 32 above second pump 20. As the upstroke continues, a portion of the column of produced water 32 is conducted or lifted to ground surface 14 and collected in a conventional manner.

Simultaneously, during the upstroke and downstroke of second pump 20, segregated produced hydrocarbons and portion of produced water 25 flow through first inlet 30 and into first pump 10. The segregated produced hydrocarbons and portion of produced water 25 are then lifted to ground surface 14 through first tubing 24 as described above with reference to FIG. 5.

Second pump 20 may also be a surface rod-driven progressive cavity pump. In such an embodiment, second pump 20 is preferably disposed within second tubing 29. Alternatively, it should be apparent to one of ordinary skill in the art that second pump, or surface rod-driven progressive cavity pump could be coupled to second tubing 29 by any suitable method, such as threaded connections. In such an embodiment, it should be apparent to one of ordinary skill in the art that second tubing 29 would preferably comprise two tubing sections. The first tubing section extends downwardly within casing 11 and is coupled to one end of second pump 20. The second tubing section is coupled to the other end of second pump 20 and extends downwardly within casing 11.

As described above sucker rod string 9 is disposed within second tubing 29 and extends to ground surface 14 where it is preferably rotated by a conventional motor (not shown). As rod string 9 is rotated, second pump 20 is likewise rotated and results in flow of fluids through second pump 20.

Reference will now be made to the operation of the alternate exemplary embodiment shown in FIG. 6 employing a surface rod-driven progressive cavity pump as second pump 20. In operation, produced fluids (hydrocarbons and water) are produced from production zone 12 via intervals 15 into casing 11 above optional seal 16 thereby forming a column of produced hydrocarbons and water within casing/tubing annulus 26. The lighter produced fluids (mostly hydrocarbons 25) rise to the top of the column while the heavier fluids (mostly water 23) settle to the bottom of the column.

During rotation of second pump 20, segregated produced water flows through second inlet 13 and into second tubing 29 below second pump 20. Second pump 20 then pumps the segregated produced water 23 (as is described above with respect to the rotor 26 and stator 22 arrangement of the progressive cavity pump shown in FIG. 4) through second tubing 29 to ground surface 14 where it is collected in a conventional manner.

Simultaneously, during rotation of second pump 20, segregated produced hydrocarbons and portion of produced water 25 flow through first inlet 30 and into first pump 10. The segregated produced hydrocarbons and portion of produced water 25 are then lifted to ground surface 14 through first tubing 24 as described above with reference to FIG. 5.

Figure 7:
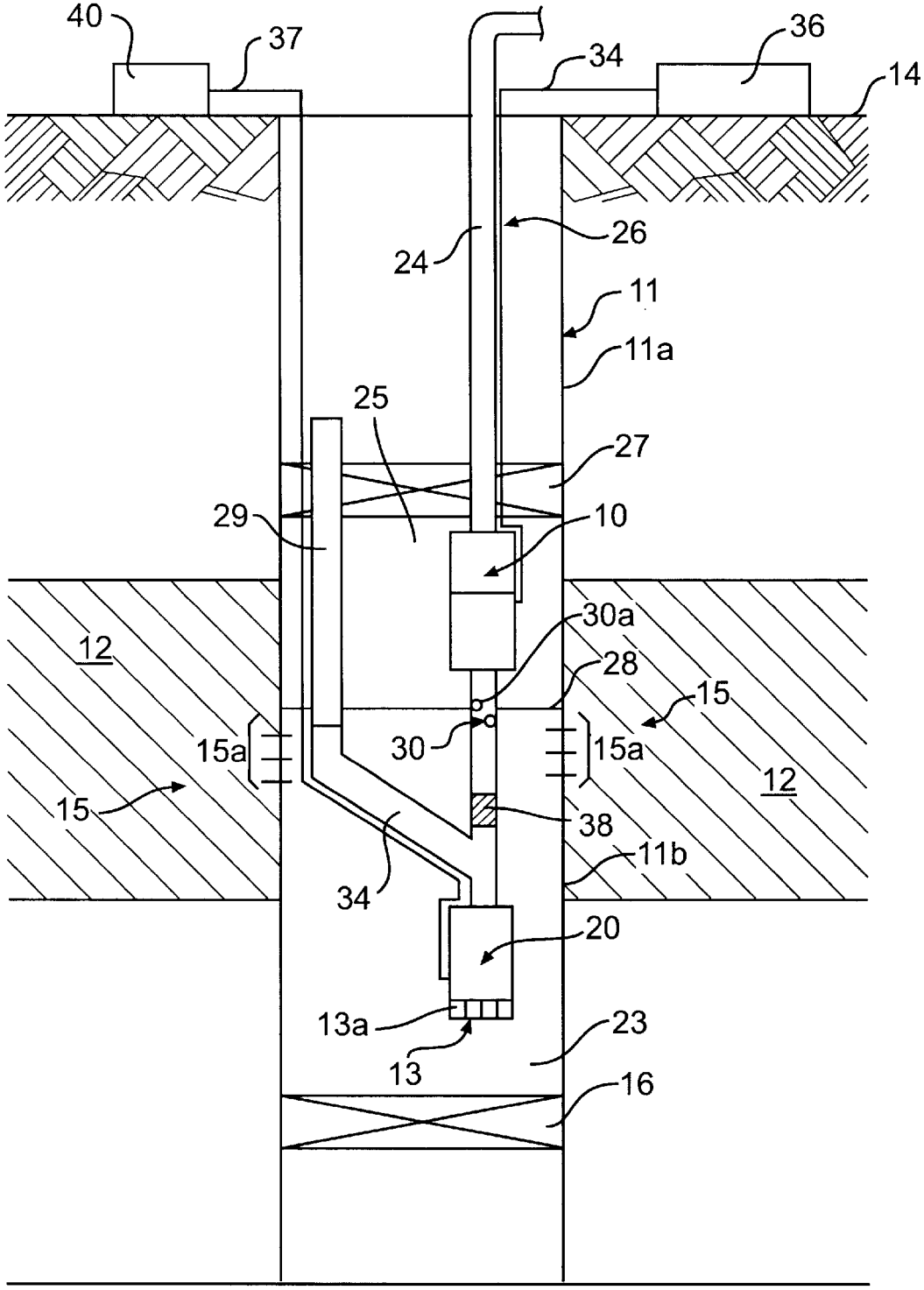
FIG. 7 is a schematic side-elevation view of a fifth exemplary embodiment of the present invention.

Reference will now be made to FIG. 7, wherein a fifth embodiment of the present invention is shown employing a first pump 10 and a second pump 20 coupled to a first tubing 24. First pump 10 and second pump 20 may be coupled to tubing 24 by any suitable method, such as threaded connections. Alternatively, first pump 10 may be disposed in first tubing 24 as described and shown above with reference to FIG. 6. First pump 10 may be an electrical submersible pump, a surface-driven rod pump, a surface rod-driven progressive cavity pump, an electrical submersible progressive cavity pump, or any other suitable downhole pump. Second pump 20 may be an electrical submersible pump, an electrical submersible progressive cavity pump, or any other suitable downhole pump.

As shown in FIG. 7, a first variable speed drive 36 may preferably be disposed at ground surface 14 to provide power to and control the pump rate of first pump 10. First pump 10 is preferably coupled to first variable speed drive 36 by a first electrical line or cable 34. Similarly, a second variable speed drive 40 may preferably be disposed at ground surface 14 to provide power to and control the pump rate of second pump 20. Second pump 20 is preferably coupled to second variable speed drive 40 by a second electrical line or cable 37. Alternatively, if a surface-driven rod pump or a surface rod-driven progressive cavity pump is employed as first pump 10, then first pump 10 will be driven in the manner described above with reference to FIG. 6.

An optional seal 16 is shown disposed within casing 11, preferably below second pump 20. As noted above, it should be understood by one of ordinary skill in the art that seal 16 may not be required if water encroachment is not a problem or if conditions within the well permit produced hydrocarbons and produced water to sufficiently segregate by gravity within casing 11. A second seal or packer 27 is disposed in casing 11. Second seal 27 divides casing 11 into an upper portion 11*a* and a lower portion 11*b*. Second seal 27, casing 11, and tubing 24 together define a casing/tubing annulus 26 in the upper portion 11*a* of casing 11. Hydrocarbons, such as oil or gas, and water flow or are "produced," into casing 11 through producing interval 15. The hydrocarbons and water segregate by gravity within the lower portion 11*b* of casing 11 forming a hydrocarbon/water interface 28. Thus, the produced hydrocarbons and water are allowed to collect in casing 11 above seal 16 and to segregate by gravity to form segregated produced water 23 below hydrocarbon/water interface 28 and segregated produced hydrocarbons and a small proportion or portion of produced water 25 above hydrocarbon/water interface 28.

A branch conduit 34, or what is commonly referred to in the art as a "Y-tool," is shown coupled to tubing 24 and second tubing 29. Tubing 29 preferably extends upwardly through, and terminates above, second seal 27. Tubing 29 may be coupled to second seal or packer 27 by any suitable method. A tubing plug 38 may preferably be disposed in tubing 24 between first pump 10 and second pump 20, and more preferably, above the intersection of branch conduit 34 and tubing 24 in order to isolate segregated produced hydrocarbons and portion of produced water 25 from segregated produced water 23 in tubing 24 and branch conduit 34.

As shown in FIG. 7, tubing 24 is coupled to first pump 10 and extends to ground surface 14 where it is coupled to suitable fluid collection mechanisms (not shown) such as tanks or pipelines. A first, or upper inlet 30 is preferably disposed in tubing 24 below first pump 10. First inlet 30 is preferably disposed in a region of casing 11 where segregated hydrocarbons and only a small proportion or portion of water 25 are expected to be present and preferably, adjacent hydrocarbon/water interface 28. The operation of first inlet 30 will be described in more detail below.

A second, or lower inlet 13 is shown disposed at a lower end of second pump 20. Second inlet 13 is preferably disposed in a region of casing 11, or more particularly, in a region of casing/tubing annulus 26, where primarily only the heavier segregated produced water 23 is present (i.e., inlet 13 is in fluid-flow communication primarily with segregated produced water 23).

Reference will now be made to the operation of the exemplary embodiment shown in FIG. 7. In operation, produced fluids (hydrocarbons and water) are produced from producing zone 12 via intervals 15 into casing 11 above seal 16 forming a column of produced hydrocarbons and water within casing 11. The lighter produced fluids (mostly hydrocarbons 25) rise to the top of the column while the heavier fluids (mostly water 23) settle to the bottom of the column.

In the embodiment shown in FIG. 7, segregated hydrocarbons and a small portion of water 25 then flows or is "pulled" through first inlet 30 and into first pump 10. First pump 10 then pumps the segregated hydrocarbons and small portion of water 25 through tubing 24 to ground surface 14 where it collected in a well-known manner.

Simultaneously, segregated produced water 23 which has settled at the bottom of casing 11 flows or is "pulled" through second inlet 13 and into second pump 20. The segregated water is then pumped through branch conduit 34 and tubing 29 to just above second seal or packer 27. Thereafter, the water flows through casing/tubing annulus 26 to ground surface 14 where it is collected in a well-known manner. It should be understood by one of ordinary skill in the art that the water may flow through casing 11 above second packer 17 to ground surface 14 under the influence of reservoir pressure, pressure caused by pumping of fluid through tubing 29, or a combination of both.

Use of two separate tubing strings, 24 and 29 (FIGS. 5 and 6) or, additionally, casing/tubing annulus 26 (FIG. 7) to lift produced hydrocarbons and produced water to ground surface 14 is preferable when there are no suitable downhole zones in which to inject produced water 23. Alternatively, such an arrangement is preferable when water is needed at ground surface 14 for purposes, such as steam generation or for waterflooding different zones. Such a system also provides economic and environmental benefits in that less surface equipment (e.g., "Free Water Knock Outs," fired heaters, separators, and emulsion treating chemicals) is needed.

As described above, the present invention provides a simple method and apparatus for providing flexibility and reliability in lifting produced hydrocarbons and only a portion of the produced water to the ground surface while simultaneously and separately lifting excess produced water to the ground surface.

The present invention can also result in less electrical power and associated costs which allows for more efficient recovery of natural hydrocarbon resources and extended life for marginal wells and fields. The present invention could also provide pressure maintenance or waterflooding as a byproduct of production.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. A downhole oil and water separation system comprising:

a casing having an interval, said casing extending from a ground surface downwardly such that said interval communicates with a producing zone so that produced liquid hydrocarbons and produced water enter said casing through said interval;

a seal disposed in said casing wherein said seal is configured so that produced liquid hydrocarbons and produced water entering said casing through said interval collect and segregate under influence of gravity above said seal;

a first pump and a second pump disposed in said casing, wherein said first pump is not drivingly coupled to said second pump;

a first inlet for permitting the segregated produced liquid hydrocarbons to enter said first pump; and a second inlet for permitting the segregated produced water to enter said second pump.

2. A system according to claim 1, further comprising:

a first tubing coupled to said first pump and a second tubing coupled to said second pump.

3. A system according to claim 2, wherein said first tubing and said second tubing extend to the ground surface.

4. A system according to claim 1, further comprising:

a second seal disposed in said casing, wherein said second seal is configured to divide said casing into an upper portion and a lower portion.

5. A system according to claim 4, further comprising:

a first tubing extending from the ground surface downwardly in said casing, wherein said first pump and said second pump are coupled to said first tubing.

6. A system according to claim 5, further comprising:

a branch conduit coupled to said first tubing.

7. A system according to claim 6, further comprising:

a second tubing coupled to said branch conduit, wherein said second tubing extends through and terminates above said second seal.

8. A system according to claim 5, further comprising:

a tubing plug disposed in said first tubing between said first pump and said second pump.

9. A system according to claim 4, further comprising:

a first tubing extending from the ground surface downwardly in said casing, wherein said first pump is disposed within said first tubing and said second pump is coupled to said first tubing.

10. A system according to claim 1, further comprising:

a first tubing and a second tubing extending from the ground surface downwardly within said casing, wherein said first pump is coupled to said first tubing and said second pump is disposed within said second tubing.

11. A system according to claim 1, further comprising:

a first tubing and a second tubing extending from the ground surface downwardly within said casing, wherein said second pump is coupled to said second tubing and said first pump is disposed within said first tubing.

12. A system according to claim 1, further comprising:

a first tubing and a second tubing extending from the ground surface downwardly within said casing, wherein said first pump is disposed within said first tubing and said first inlet is disposed in said first tubing below said first pump and said second pump is disposed within said second tubing and said second inlet is disposed in said second tubing below said second pump.

13. A system according to claim 1, further comprising:

a first variable speed drive coupled to said first pump for controlling an output of said first pump.

14. A system according to claim 1, further comprising:

a second variable speed drive coupled to said second pump for controlling the output of said second pump.

15. A method for selectively lifting fluids, including produced hydrocarbons and produced water, from a subterranean well to a ground surface, the method comprising:

allowing produced water and produced hydrocarbons to collect and to segregate above a seal disposed in a casing in the subterranean well;

controlling a first pump to lift the segregated produced hydrocarbons and a portion of the produced water through a first tubing to the ground surface; and independently controlling a second pump to lift the segregated produced water through a second tubing to the ground surface.

16. A method according to claim 15, wherein the second tubing terminates above a second seal disposed in the casing so that in said indendently controlling step the segregated produced water is lifted through the second tubing and thereafter through the casing to the ground surface.

* * * * *